US009230480B2

(12) United States Patent
Park

(10) Patent No.: US 9,230,480 B2
(45) **Date of Patent: *Jan. 5, 2016**

(54) ORGANIC EMITTING DISPLAY DEVICE AND DRIVING METHOD THEREOF

(71) Applicant: Samsung Display Co., Ltd., Yongin, Gyeonggi-Do (KR)

(72) Inventor: Hong-Sik Park, Yongin (KR)

(73) Assignee: SAMSUNG DISPLAY CO., LTD. (KR)

( * ) Notice: Subject to any disclaimer, the term of this patent is extended or adjusted under 35 U.S.C. 154(b) by 83 days.

This patent is subject to a terminal disclaimer.

(21) Appl. No.: 14/133,060

(22) Filed: Dec. 18, 2013

(65) Prior Publication Data

US 2015/0029239 A1 Jan. 29, 2015

(30) Foreign Application Priority Data

Jul. 23, 2013 (KR) ..... 10-2013-0086906

(51) Int. Cl.
*G09G 3/34* (2006.01)
*G09G 3/32* (2006.01)

(52) U.S. Cl.
CPC ..... *G09G 3/3241* (2013.01); *G09G 3/325* (2013.01); *G09G 2300/043* (2013.01); *G09G 2300/0426* (2013.01); *G09G 2300/0814* (2013.01); *G09G 2300/0819* (2013.01); *G09G 2300/0823* (2013.01); *G09G 2300/0876* (2013.01); *G09G 2320/045* (2013.01)

(58) Field of Classification Search
CPC .... G09G 3/033; G09G 3/3241; G09G 3/3291
See application file for complete search history.

(56) References Cited

U.S. PATENT DOCUMENTS

| | | | | |
|---|---|---|---|---|
| 8,982,019 | B2 * | 3/2015 | Han | 345/76 |
| 2005/0264228 | A1 * | 12/2005 | Kim | 315/169.3 |
| 2011/0279484 | A1 * | 11/2011 | Han et al. | 345/690 |

FOREIGN PATENT DOCUMENTS

| | | | |
|---|---|---|---|
| KR | 1020050090861 | A | 9/2005 |
| KR | 1020100006106 | A | 1/2010 |
| KR | 1020120065139 | A | 6/2012 |
| KR | 1020120133624 | A | 12/2012 |

* cited by examiner

*Primary Examiner* — Gerald Johnson
*Assistant Examiner* — Sepehr Azari
(74) *Attorney, Agent, or Firm* — Cantor Colburn LLP

(57) ABSTRACT

An organic light emitting diode ("OLED) display comprises a plurality of pixels which receives a first data signal, which is a data signal of a frame, through a plurality of data lines connected thereto, and stores the first data signal during a frame period of the frame, where the pixels simultaneously emit light based on a driving current corresponding to a second data signal, which is a data signal of a previous frame, where the frame period includes a scan period, during which the first data signal is stored, and a light emission period, during which the light is emitted based on the second data signal, the scan period and the light emission period overlap each other in the frame period.

17 Claims, 6 Drawing Sheets

ORGANIC EMITTING DISPLAY DEVICE AND DRIVING METHOD THEREOF

This application claims priority to Korean Patent Application No. 10-2013-0086906, filed on Jul. 23, 2013, and all the benefits accruing therefrom under 35 U.S.C. §119, the content of which in its entirety is herein incorporated by reference.

BACKGROUND

1. Field

Exemplary embodiments of the invention relate generally to an organic light emitting diode ("OLED") display and a driving method thereof.

2. Description of the Related Art

A display device has been used for a personal computer, a portable phone, a portable information terminal such as a personal digital assistants ("PDA"), and the like, or monitors of various information devices. The display device typically includes a liquid crystal display ("LCD") using a liquid crystal panel, an organic light emitting diode display ("OLED") using an organic light emitting element, a plasma display panel ("PDP") using a plasma panel. Particularly, the OLED display has high luminance efficiency and wide viewing angle and quick response speed.

The OLED display typically includes a display area formed by arranging a plurality of pixels substantially in a matrix form on a substrate, and a data signal is selectively applied to a pixel by connecting a scan line and a data line to each pixel for displaying an image.

Such an OLED display is typically classified into a passive matrix type OLED display and an active matrix type OLED display. The passive matrix OLED display typically includes a positive electrode and a negative electrode disposed to cross each other and is driven on a line-by-line basis.

The active matrix type OLED display is driven by controlling a current flowing to an organic light emitting diode by maintaining data signal switched by a switching transistor with a capacitor and applying the data signal to a driving transistor. Such an OLED display may be used in a stereoscopic display device that displays a stereoscopic image.

FIG. 1 is a conceptual diagram showing a conventional driving method of an active matrix type of OLED display.

Referring to FIG. 1, a frame period for displaying a stereoscopic image is divided into sub-frames of a left-eye image section LI and a right-eye image section RI. The left-eye image section LI includes a scan section LN1 for writing left-eye image data and a light emission section LE1 for light emission based on the left-eye image data, and the right-eye image section RI includes a scan section RN1 for writing right-eye image data and a light emission section RE1 for light emission based on the right-eye image data.

As described above, a left-eye image and a right-eye image are sequentially displayed during a frame period corresponding to a driving frequency (e.g., 60 Hz), and shutter glass ("SG") type spectacles are selectively opened and closed to realize a stereoscopic image at a time when the left-eye image is displayed and at a time when the right-eye image is displayed.

SUMMARY

Exemplary embodiments of the invention described herein relate to an organic light emitting diode ("OLED") display including a large size display panel, having high resolution and displaying of a stereoscopic image with increased aperture ratio, and a method for driving the OLED display.

An exemplary embodiment of OLED display includes a plurality of pixels which receives a first data signal, which is a data signal of a frame, through a plurality of data lines connected thereto, and stores the first data signal during a frame period of the frame, where the pixels simultaneously emit light based on a driving current corresponding to a second data signal, which is a data signal of a previous frame, where the frame period includes a scan period, during which the first data signal is stored, and a light emission period, during which the light is emitted based on the second data signal, the scan period and the light emission period overlap each other in the frame period. In such an embodiment, each of the plurality of pixels includes: a first transistor connected to a corresponding data line of the plurality of data lines and a first node; a first capacitor connected between the first node and a second node; a second capacitor connected between a third node and a fourth node; a second transistor connected between the second node and the third node; a third transistor including a gate electrode connected to the fourth node, a source electrode to which a first power source voltage is transmitted, and a drain electrode connected to a fifth node; a fourth transistor which transmits an initialization voltage to the fifth node; and a fifth transistor connected between the third transistor and an organic light emitting diode.

In an exemplary embodiment, the frame period may further include an initialization period during which the plurality of pixels are initialized, and a data transmission period during which the first data signal written to the first capacitor is transmitted to the second capacitor.

In an exemplary embodiment, the fourth transistor maintains a turn-on state during the initialization period.

In an exemplary embodiment, a threshold voltage of the third transistor may be compensated during the data transmission period.

In an exemplary embodiment, each of the plurality of pixels may further include a sixth transistor which diode-connects the gate electrode and the drain electrode of the third transistor during the data transmission period.

In an exemplary embodiment, each of the plurality of pixels may further include a seventh transistor which transmits a reference voltage to the second node and an eighth transistor which transmits the reference voltage to the third node.

In an exemplary embodiment, the seventh transistor and the eighth transistor may be maintained in a turn-on state during the scan period and the initialization period.

In an exemplary embodiment, the second transistor may be maintained in a turn-off state during the scan period, and maintained in a turn-off state during the initialization period and the data transmission period.

In an exemplary embodiment, the first data signal may be an image data signal of one of a first view point and a second view point corresponding to the frame, and the second data signal may be an image data signal of the other of the first view point and the second view point corresponding to the previous frame.

In an exemplary embodiment, the frame period may further include a blank period overlaps the scan period by a predetermined time, and the organic light emitting diode does not emit light during the blank period.

In an exemplary embodiment, the fifth transistor may be maintained in a turn-off state during the blank period.

In an exemplary embodiment, a method of driving an organic light emitting diode display including a plurality of pixels, the method including: transmitting a first data signal, which is a data signal of a frame, to the plurality of pixels through a plurality of data lines connected to the plurality of pixels during a frame period of the frame, and storing the first data signal in a first capacitor of each of the plurality of pixels during a scan period in the frame period; and simultaneously emitting light from a plurality of organic light emitting diodes of the plurality of pixels based on a driving current corresponding to a second data signal, which is a data signal of a previous frame, during a light emission period in the frame period, where the scan period and the light emission period overlap each other in the frame period, and each of the plurality of pixels includes: a first transistor connected to a corresponding data line of the plurality of data lines and a first node; the first capacitor connected between the first node and a second node; a second capacitor connected between a third node and a fourth node; a second transistor connected between the second node and the third node; a third transistor including a gate electrode connected to the fourth node, a source electrode to which a first power source voltage is transmitted, and a drain electrode connected to a fifth node; a fourth transistor which transmits an initialization voltage to the fifth node; and a fifth transistor connected between the third transistor and an organic light emitting diode.

In an exemplary embodiment, the method may further include initializing the drain electrode of the third transistor to the initialization voltage during an initialization period in the frame period; and transmitting the first data signal written to the first capacitor to the second capacitor during a data transmission period in the frame period.

In an exemplary embodiment, the transmitting the first data signal may include compensating a threshold voltage of the third transistor.

In an exemplary embodiment, the compensating the threshold voltage may include diode-connecting the gate electrode and the drain electrode of the third transistor.

In an exemplary embodiment, the method may further include transmitting a reference voltage to the second node and the third node during the scan period and the initialization period.

In an exemplary embodiment, the method may further include stopping a light emission from the plurality of organic light emitting diodes during a blank period in the frame period, where the blank period overlaps the scan period by a predetermined time.

According to exemplary embodiments of the invention, a scan period and a light emission period overlap each other by a predetermined time in a frame period, and a plurality of pixels simultaneously emit light during the light emission period such that the light emission period may be sufficiently assured and pixel deterioration may be effectively prevented.

In such embodiments, a blank period is inserted in an initial stage of the scan period such that occurrence of crosstalk in displaying of a stereoscopic image may be effectively prevented.

In such embodiments, a driving current flowing to the plurality of pixels may be controlled substantially independently of a power source voltage and a threshold voltage, such that luminance non-uniformity due to deviation of the power source voltage and the threshold voltage may be effectively compensated.

BRIEF DESCRIPTION OF THE DRAWINGS

The above and other features of the invention will become more apparent by describing in further detail exemplary embodiments thereof with reference to the accompanying drawings, in which.

DETAILED DESCRIPTION

Figure 1:
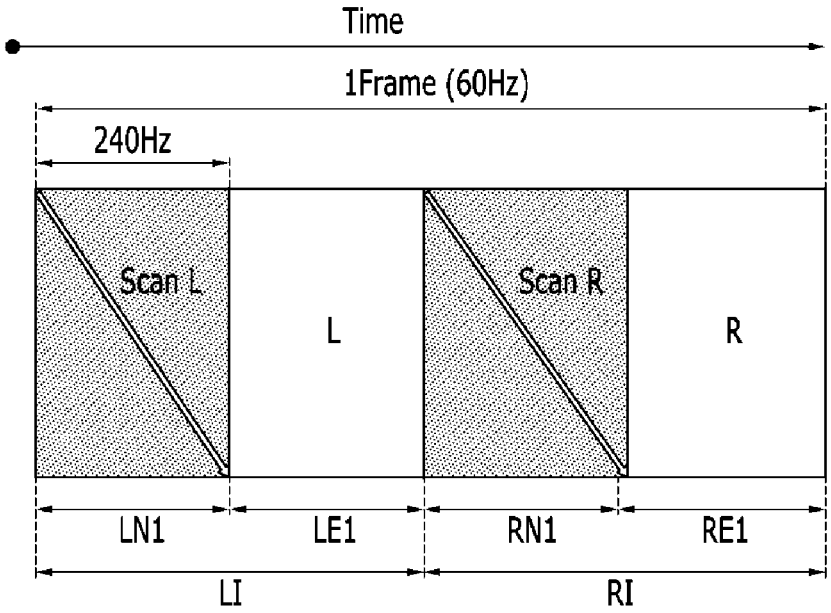
FIG. 1 Prior Art
FIG. 1 is a conceptual diagram showing a conventional driving method of an active matrix-type organic light emitting diode display.

The invention will be described more fully hereinafter with reference to the accompanying drawings, in which embodiments of the invention are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on," "connected to" or "coupled to" another element or layer, the element or layer can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

In a conventional driving method of the OLED described with reference to FIG. 1, to display a left-eye image and a right-eye image during a frame period corresponding to the driving frequency (e.g., 60 Hz), the frame is divided into a scan period and a light emission period and therefore each scan or light emission period may be processed with a frequency corresponding to a quarter of the frame period (e.g., 240 Hz). In such a conventional driving method, when the left-eye image and the right-eye image are alternately displayed, crosstalk may occur such that the left-eye image and the right-eye image may be simultaneously viewed. In such a conventional driving method, a blank section that maintains a plurality of pixels in a non-light emission state may be inserted between the sections displaying the left-eye image and the right-eye image to prevent occurrence of the crosstalk such that a blank section of at least one frame may be provided in the frame period.

In such a conventional driving method, when scan periods and light emission periods of all pixels of the display panel are separated and an image is simultaneously displayed in all pixels during the light emission period, a motion blur may be effectively prevented from occurring or a three-dimensional stereoscopic image may be easily realized. However, the light emission period is limited to less than half of one frame, and therefore luminance may not be accurately displayed.

Thus, light emission luminance may be increased to accurately display average luminance even when the OLED is not driving in a stereoscopic image mode, and accordingly a power source voltage is increased and power consumption is thereby increased. In addition, the driving current is increased in light emission such that luminance non-uniformity due to a voltage drop (e.g., IR drop) is relatively increased.

Hereinafter, exemplary embodiments of the invention will be described in further detail with reference to FIGS. 2 to 6.

Figure 2:
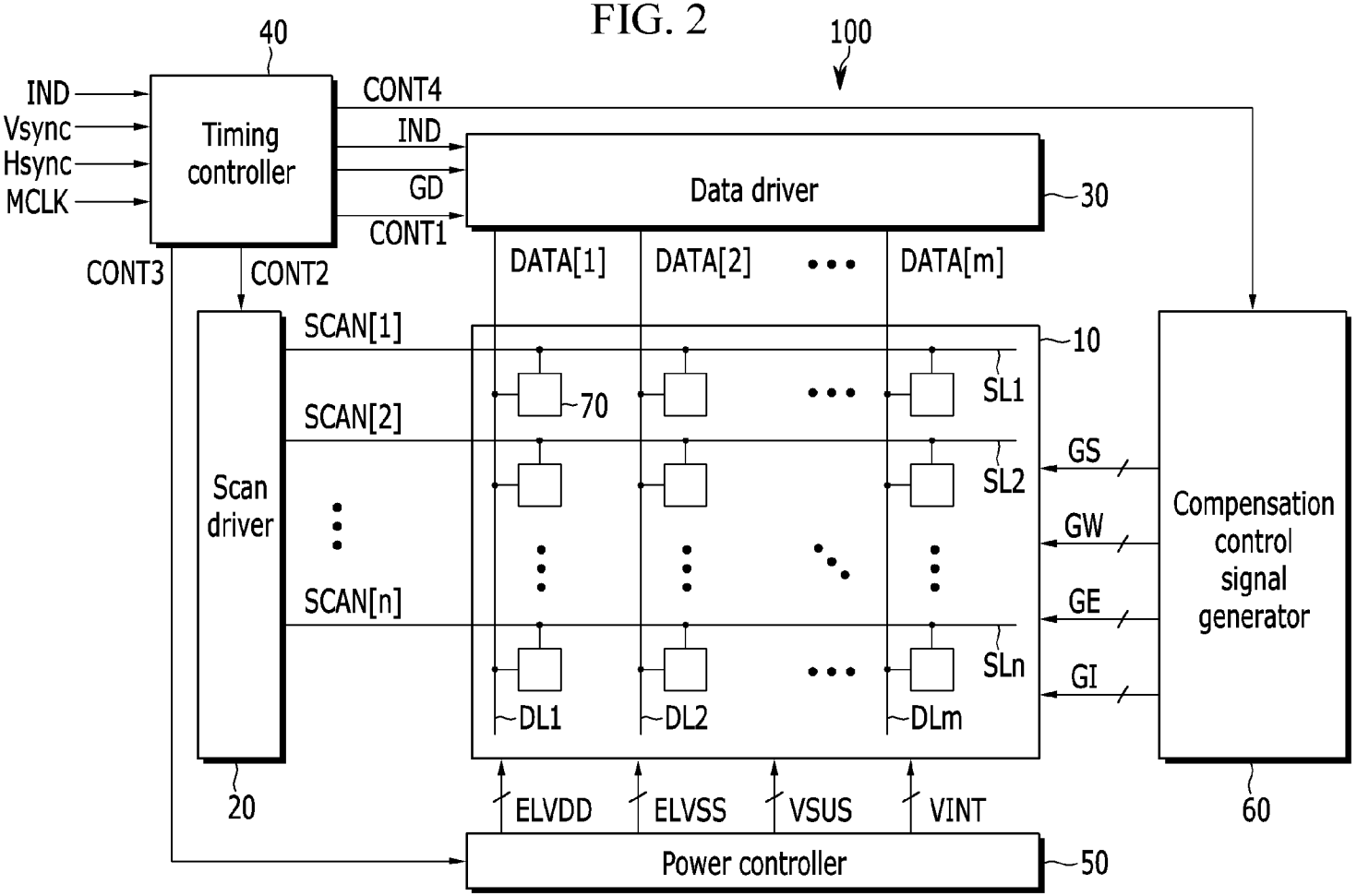
FIG. 2 is a block diagram showing an exemplary embodiment of an organic light emitting diode display, according to the invention.

FIG. 2 is a block diagram of an OLED display, according to the invention.

Referring to FIG. 2, an exemplary embodiment of an OLED display 100 includes a display unit 10, a scan driver 20, a data driver 30, a timing controller 40, a power controller 50 and a compensation control signal generator 60.

The display unit 10 includes a plurality of pixels 70 for displaying an image by emitting light based on image data GD corresponding to an external video signal IND. Each of the plurality of pixels 70 is connected to a corresponding data line among a plurality of data lines DL1 to DLm and a corresponding scan line among a plurality of scan lines SL1 to SLn. In such an embodiment, each of the plurality of pixels 70 receives a first power source voltage ELVDD, a second power source voltage ELVSS, a reference voltage VSUS and an initialization voltage VINT.

In an exemplary embodiment, each of the plurality of pixels 70 receives a corresponding first control signal among a plurality of the first control signals GS, a corresponding second control signal GW among a plurality of second control signals GW, a corresponding third control signal among a plurality of third control signals GE, and a corresponding forth control signal among a plurality of fourth control signals GI.

The scan driver 20 generates a plurality of scan signals SCAN[1] to SCAN[n] for transmission of the corresponding data signal to each of the plurality of pixels 70 based on a scan control signal CONT2. In addition, the scan driver 20 sequentially transmits a plurality of scan signals SCAN[1] to SCAN [n] and a plurality of scan signals SL1 to SLn.

In such an embodiment, the data driver 30 generates a plurality of data signals DATA[1]-DATA[m] by sampling and holding the image data signal GD based on a data control signal CONT1. The data driver 30 transmits the plurality of data signals DATA[1] to DATA[m] to the data lines DL1 to DLm, respectively.

The power controller 50 generates the first power source voltage ELVDD, the second power source voltage ELVSS, the reference voltage VSUS, and the initialization voltage VINT based on a power control signal CONT3. The power controller 50 may controls a voltage level of each of the first power source voltage ELVDD, the second power source voltage ELVSS, the reference voltage VSUS, and the initialization voltage VINT based on the power control signal CONT3.

The compensation control signal generator 60 generates the plurality of first control signals GS, the plurality of second control signals GW, the plurality of third control signals GE and the plurality of fourth control signals GI based on a compensation control signal CONT4.

The timing controller 40 receives the external video signal IND and a synchronization signal, converts the external image signal IND to the image data signal GD, and controls operations and driving of constituent elements of the display, e.g., the scan driver 20, the data driver 30, the power controller 50 and the compensation control signal generator 60, by generating the data control signal CONT1, the scan control signal CONT2, the power control signal CONT3 and the compensation control signal CONT4 based on the synchronization signal. In an exemplary embodiment, the synchronization signal includes a vertical synchronization signal Vsync, a horizontal synchronization signal Hsync and a main clock signal MCLK.

The timing controller 40 divides the image signal IND by a unit of a frame period based on the vertical synchronization signal Vsync, and divides the image signal IND by a scan line unit based on the horizontal synchronization signal Hsync to generate the image data signal GD.

Figure 3:
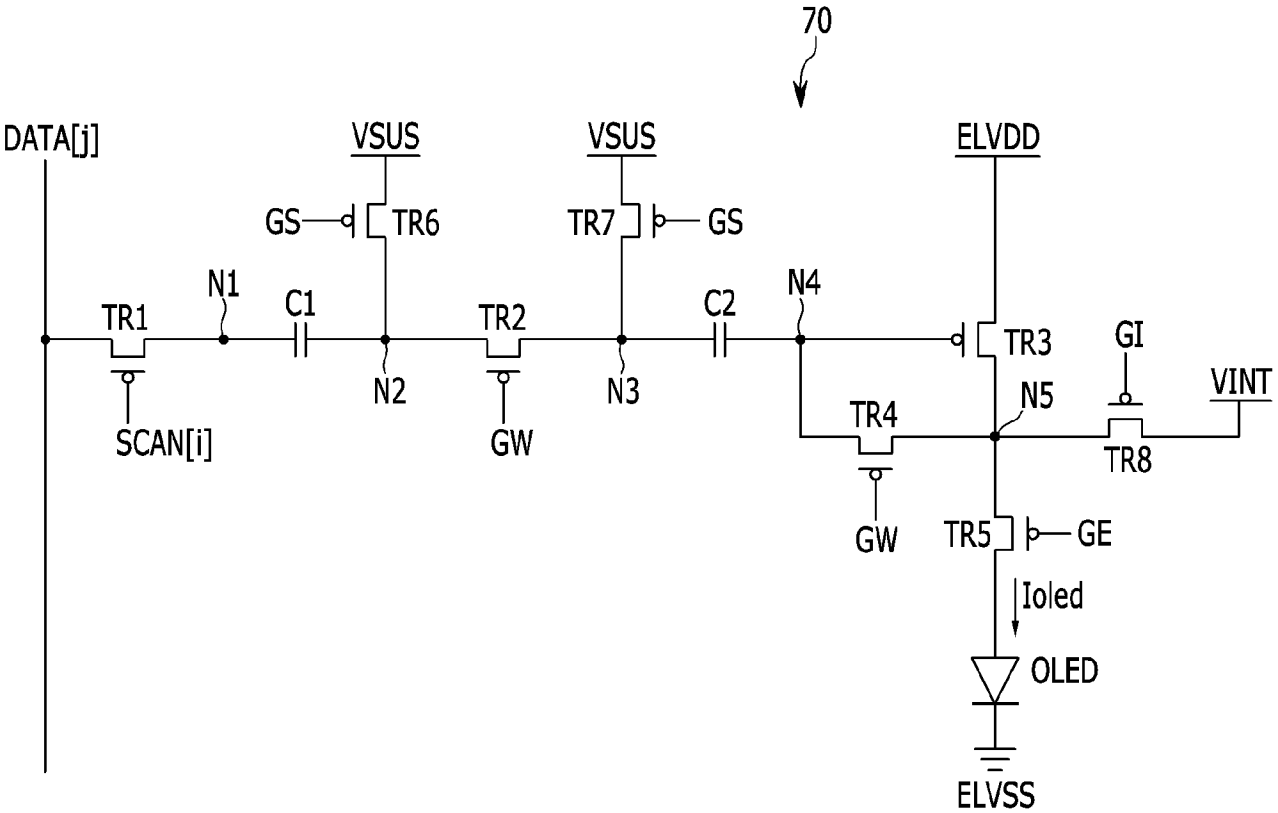
FIG. 3 is a circuit diagram showing an exemplary embodiment of a pixel of the organic light emitting diode display of FIG. 2.

FIG. 3 is a circuit diagram showing an exemplary embodiment of the pixel 70 of the OLED of FIG. 1.

Referring to FIG. 3, in an exemplary embodiment, each pixel 70 of the OLED includes an organic light emitting diode OLED that emits light of a color based on a corresponding data signal among the plurality of data signals DATA[1] to DATA[m], and a driving circuit. The driving circuit includes 8 transistors, e.g., first to eighth transistors TR1 to TR8, and 2 capacitors, e.g., a first capacitor C1 and a second capacitor C2. In such an embodiment, as shown in FIG. 3, each pixel 70 is connected to the corresponding scan line, e.g., an i-th scan line SL[i], and the corresponding data line, e.g., a j-th data line DL[j].

The first transistor TR1 includes a first electrode to which a data signal, e.g., an j-th data signal DATA[j] is transmitted, a gate electrode to which a scan signal, e.g., an i-th scan signal SCAN[i], is transmitted, and a second electrode connected to a first node N1. In such an embodiment, the first transistor TR1 is turned on by the scan signal SCAN[i] and transmits a voltage (hereinafter referred to as a "data voltage") corresponding to the data signal DATA[j] to the first node N1.

The second transistor TR2 includes a first electrode connected to a second node N2, a gate electrode to which the second control signal GW is transmitted, and a second electrode connected to a third node N3. In such an embodiment, the second transistor TR2 is turned on by the second control signal GW, and transmits the data voltage stored in the first capacitor C1 to the third node N3.

The third transistor TR3 includes a source electrode to which the first power source voltage ELVDD is transmitted, a gate electrode connected to a fourth node N4, and a drain electrode connected to a fifth node N5. The third transistor TR3 is a driving transistor that drives the organic light emitting diode OLED. The third transistor TR3 controls a driving current flowing to the organic light emitting diode OLED based on a voltage of the fourth node N4.

The fourth transistor TR4 includes a first electrode connected to the fourth node N4, a gate electrode to which the second control signal GW is transmitted, and a second electrode connected to the fifth node N5. In such an embodiment, the fourth transistor TR4 is a threshold voltage compensation transistor that compensates a threshold voltage of the third transistor TR3. The fourth transistor TR4 is turned on by the second control signal GW and diode-connects the drain electrode and the gate electrode of the third transistor TR3.

The fifth transistor TR5 includes a first electrode connected to the fifth node N5, a gate electrode to which the third control signal GE is transmitted, and a second electrode connected to an anode of the organic light emitting diode OLED. The fifth transistor TR5 includes a light emission control transistor that transmits a driving current flowing through the third transistor TR3 to the organic light emitting diode OLED. The fifth transistor TR5 is turned on by the third control signal GE, and connects the fifth node N5 and an anode of the organic light emitting diode OLED.

The sixth transistor TR6 includes a first electrode to which the reference voltage VSUS is transmitted, a gate electrode to which the first control signal GS is transmitted, and a second electrode connected to the second node N2. The sixth transistor TR6 is turned on by the first control signal GS and transmits the reference voltage VSUS to the second node N2.

The seventh transistor TR7 includes a first electrode to which the reference voltage VSUS is transmitted, a gate electrode to which the first control signal GS is transmitted, and a second electrode connected to the third node N3. The seventh transistor TR7 is turned on by the first control signal GS and transmits the reference voltage VSUS to the third node N3.

The eighth transistor TR8 includes a first electrode connected to the fifth node N5, a gate electrode to which the fourth control signal GI is transmitted, and a second electrode to which the initialization voltage VINT is transmitted. The eighth transistor TR8 is turned on by the fourth control signal GI and transmits the initialization voltage VINT to the fifth node N5.

The first capacitor C1 includes a first electrode connected to the first node N1 and a second electrode connected to the second node N2. In such an embodiment, the first capacitor C1 stores a data voltage of a current frame, which is transmitted through the corresponding data line DL[j].

The second capacitor C2 includes a first electrode connected to the third node N3 and a second electrode connected to the fourth node N4. In such an embodiment, the second capacitor C2 maintains a data voltage of a previous frame. In such an embodiment, the organic light emitting diode OLED includes a cathode to which the second power source voltage ELVSS is transmitted.

In an exemplary embodiment, the first to eighth transistors TR1 to TR8 may be p-channel field effect transistors. In such an embodiment, a gate-on voltage that turns on the first to eighth transistors TR1 to TR8 is a low-level voltage and a gate-off voltage that turns off the first to eighth transistors TR1 to TR8 is a high-level voltage. In such an embodiment, one of the first electrode and the second electrode of each of the first to eighth transistors TR1 to TR8 may be a source electrode.

In an alternative exemplary embodiment, at least one of the first to eighth transistors TR1 to TR8 may be an n-channel field effect transistor.

Figure 4:
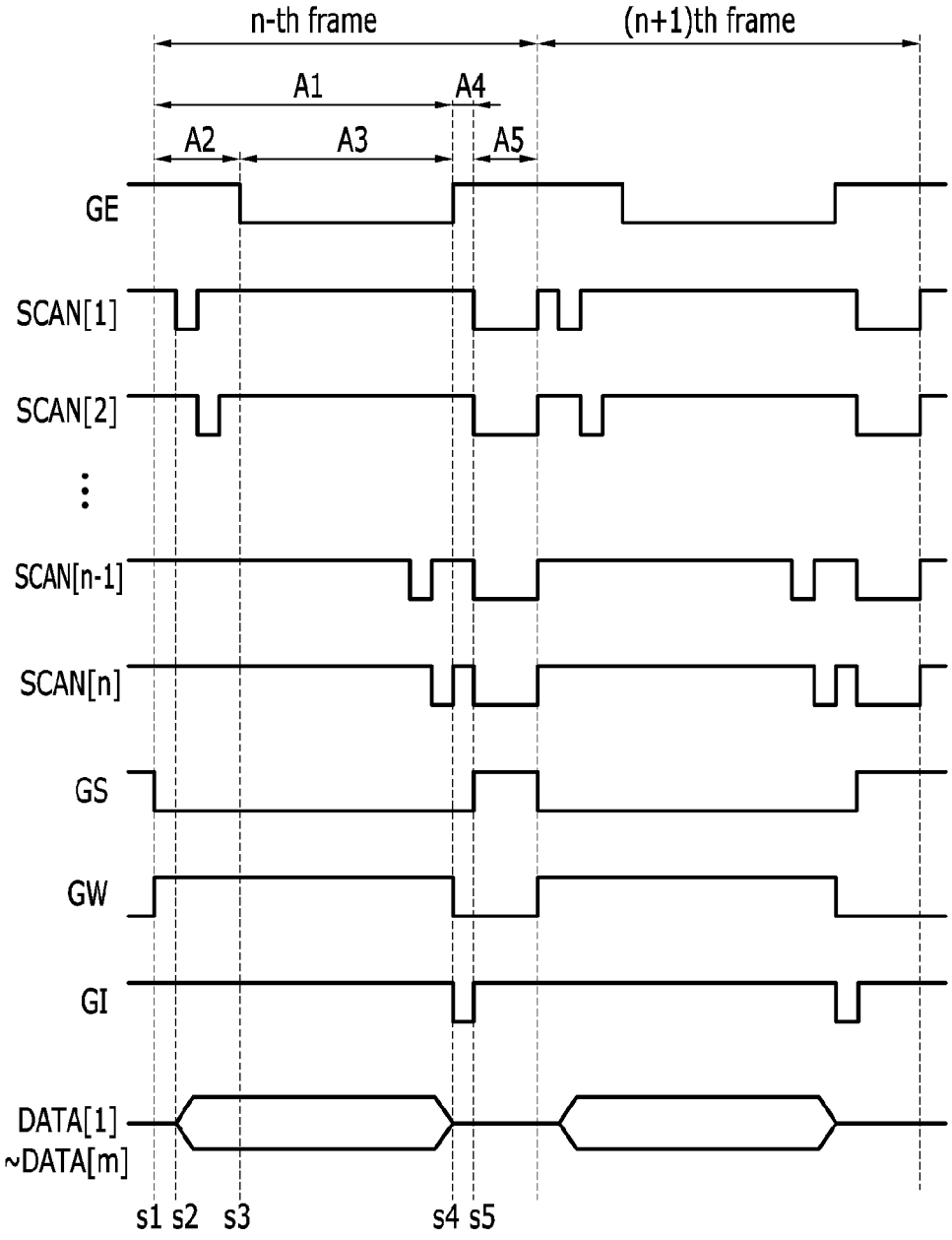
FIG. 4 is a signal timing diagram showing an exemplary embodiment of a driving method of an organic light emitting diode display, according to the invention.

FIG. 4 is a signal timing diagram showing an exemplary embodiment of a driving method of the OLED display, according to the invention.

Referring to FIGS. 3 and 4, in an exemplary embodiment, the first control signal GS is decreased to a low level from a high level at a first time point s1. Then, the sixth transistor TR6 is turned on, and thus a potential of the second node N2 is maintained at a level of the reference voltage VSUS. When the first control signal GS is decreased to the low level from the high level, the seventh transistor TR7 is turned on, and thus a potential of the third node N3 is maintained at the level of the reference voltage VSUS level. At the first time point s1, the second to fourth control signals GW, GE and GI maintain in an inactive state with a high level.

Next, at a second time point s2, the scan signal SCAN[1] is transmitted with a low level to the scan line SL[1], and the plurality of scan signals SCAN[2] to SCAN[n] are sequentially transmitted to the corresponding scan lines SL[2] to SL[n] thereafter. When the corresponding scan signal SCAN [i] is transmitted with the low level, the first transistor TR1 is turned on, and a data signal DATA[j] of the current frame is transmitted to the first capacitor C1.

In an exemplary embodiment, the third control signal GE maintains an inactivate state with a high level during a blank period A2 in a scan period A1. In such an embodiment, the blank period A2 during which the organic light emitting diode OLED is maintained in a non-light emission state is inserted to the scan period A1 to thereby effectively prevent crosstalk when displaying a stereoscopic image. In such an embodiment, the length of the blank period A2 may be independently controlled. In such an embodiment, when displaying the stereoscopic image, the data signal DATA[j] may include an image data signal of a first view point, e.g., a left eye image data signal, or an image data signal of a second view point, e.g., a right eye image data signal.

At a third time point s3, the third control signal GE is decreased to a low level from a high level, such that the fifth transistor TR5 is turned on, and thus the drain electrode of the third transistor T3 and the anode of the organic light emitting diode OLED are connected.

Accordingly, a driving current Ioled flowing through the third transistor T3 and corresponding to a data voltage of the previous frame, which is stored in the second capacitor C2 during a light emission period A3, is transmitted to the organic light emitting diode OLED, and thus the organic light emitting diode OLED emits light. During a period between the first time point s1 and the third time point s3, the seventh transistor TR7 maintains the turn-on state by the first control signal GS, and therefore the first electrode of the second capacitor C2 are maintained at the level of the reference voltage VSUS. In such an embodiment, the driving current Ioled flowing to the organic light emitting diode OLED satisfies the following Equation 1.

$$\begin{aligned} Ioled &= k \times (Vsg - Vth)^2 \\ &= k \times \left\{ \frac{Cp1 \times (VSUS - VDATA) + Cp2 \times (ELVDD - VINT - Vth)}{Cp1 + Cp2} \right\}^2 \\ &= k \times \left\{ \frac{Cp1 \times (VSUS - VDATA)}{Cp1 + Cp2} \right\}^2 \end{aligned}$$

Equation 1

In Equation 1, k denotes a parameter determined by a characteristic of the third transistor TR3, Vsg denotes a source-gate voltage of the third transistor TR3, Vth denotes a threshold voltage of the third transistor TR3, VDATA denotes the data voltage and Cp1 and Cp2 denote a capacitance of the first capacitor C1 and a capacitance of the second capacitor C2, respectively. Here, when the capacitance of the first capacitor C and the capacitance of the second capacitor C2 are set to satisfy the following inequation: Cp1>>Cp2, a value of (ELVDD-VINT-Vth) in Equation 1 becomes negligibly small. That is, influences of the first power source voltage ELVDD and the initialization voltage VINT are minimized, and the organic light emitting diode OLED may be driven with the reference voltage VSUS and the data voltage VDATA.

Then, during an initialization period A4, the third control signal GE is increased to a high level from a low level at a fourth time period s4. Then, the fifth transistor TR5 is turned off and the organic light emitting diode OLED does not emit light. At the fourth time point s4, the fourth control signal GI is decreased to a low level from a high level. Then, the eighth transistor TR8 is turned on, and thus the initialization voltage VINT is transmitted to the drain electrode of the third transistor TR3. Accordingly, the third transistor TR3 in each of the plurality of pixels 70 is initialized.

At the fourth time point s4, the second control signal GW is decreased from a high level to a low level, and thus the fourth transistor TR4 is turned on, such that the fourth node N4 and the fifth node N5 are connected.

When the second control signal GW is decreased from the high level to the low level, the second transistor TR2 is turned on such that the second node N2 and the third node N3 are connected. At the fourth time point s4, the plurality of scan signals SCAN[1] to SCAN[n] are transmitted with a high level, and thus the first transistor TR1 is in the turn-off state, such that the first electrode of the first capacitor C1 maintains a floated state. At the fourth time point s4, the sixth and seventh transistors TR6 and TR7 are maintained in the turn-on state, and therefore the first electrode of the second capacitor C2 is maintained at the level of the reference voltage VSUS.

During a data transmission and compensation period A5, the plurality of scan signals SCAN[1] to SCAN[n] are transmitted with a low level at a fifth time point s5. Then, the first transistor TR1 is turned on and the first electrode of the first capacitor C1 is connected to the data lines DL1 to DLm. Accordingly, a data voltage VDAT of the current frame, which is stored in the first capacitor C1, is transmitted to the second capacitor C2. At the fifth time point s5, the first control signal GS is increased to the high level from the low level, and the sixth and seventh transistors TR6 and TR7 are thereby turned off. At the fifth time point s5, the fourth control signal GI is decreased to the low level from the high level, and thus the eighth transistor T8 is turned off.

At the fifth time point s5, the second control signal GW is maintained in the low level, such that the fourth transistor T4 is maintained in the turn-off state, and therefore the gate electrode and the drain electrode of the third transistor T3 are diode-connected. Accordingly, a voltage, to which the threshold voltage Vth of the third transistor T3 is reflected, is stored in the second capacitor C2.

In such an embodiment, in a frame period (e.g., an n-th frame), the scan period A1, during which the data of the current frame is written to the first capacitor C1, and the light emission period A3, during which the entire pixels 70 emit light based on data of the previous frame stored in the second capacitor C2, overlap each other by a predetermined time. Accordingly, the light emission period A3 is sufficiently assured without increasing the driving current Ioled, thereby effectively preventing deterioration of the pixels 70.

In such an embodiment, the blank period A2 is inserted to the initial stage of the scan period A1, such that crosstalk that may occur by simultaneous displaying of a left-eye image and a right-eye image is effectively prevented when displaying a stereoscopic image.

In such an embodiment, a voltage level of the first power source voltage ELVDD or the second power source voltage ELVSS are not changed, e.g., increased or decreased, such that the power circuit may have a simple structure. In such an embodiment, the driving current Ioled of each of the plurality of pixels 70 may be controlled substantially independently of the first power source voltage ELVDD and the threshold voltage Vth of the driving transistor, and therefore luminance non-uniformity due to deviation of the first power source voltage ELVDD and the threshold voltage Vth may be effectively compensated.

Figure 5:
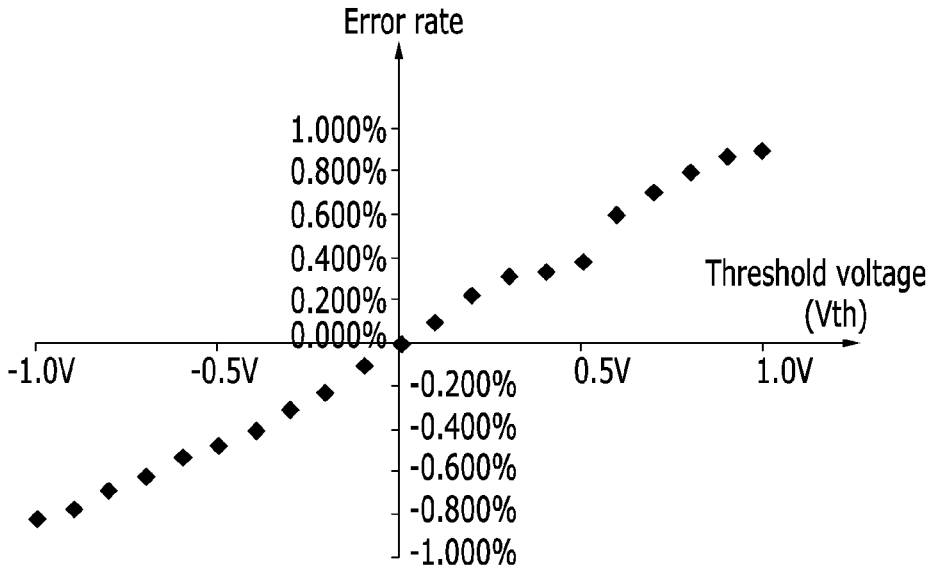
FIG. 5 and FIG. 6 are graphs showing results of a simulation driving of a pixel of an organic light emitting diode display, according to the invention.
Figure 6:
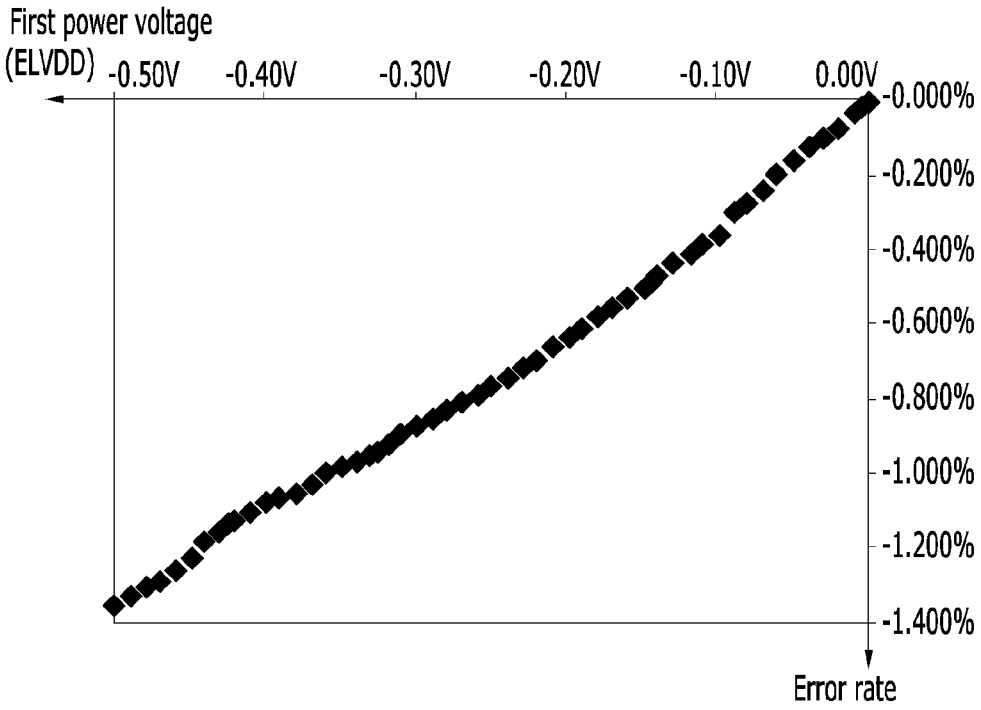

FIG. 5 and FIG. 6 are graphs showing results of simultaneous driving of the pixel 70 of an exemplary embodiment of an organic light emitting diode display, according to the invention.

As shown in FIG. 5, in an exemplary embodiment, when the threshold voltage Vth of the third transistor TR3 is changed to about +1.0 volt (V) from about −1.0 V, a maximum error of about 0.9% occurs in the driving current Ioled flowing to the organic light emitting diode OLED. In an exemplary embodiment, as shown in FIG. 6, when a voltage drop of from about zero (0) V to about −0.5 V occurs in the first power source voltage ELVDD, a maximum error of about 1.35% occurs in the driving current Ioled. In such an embodiment, the pixel 70 may effectively minimize an error of the driving current Ioled due to deviation of the threshold voltage Vth or the first power source voltage ELVDD.

While this disclosure has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An organic light emitting diode display comprising:

a plurality of pixels which receives a first data signal, which is a data signal of a frame, through a plurality of data lines connected thereto, and stores the first data signal during a frame period of the frame, wherein the pixels simultaneously emit light based on a driving current corresponding to a second data signal, which is a data signal of a previous frame, wherein the frame period comprises a scan period, during which the first data signal is stored, and a light emission period, during which the light is emitted based on the second data signal, the scan period and the light emission period overlap each other in the frame period, and each of the plurality of pixels comprises:

a first transistor electrically and physically connected to a corresponding data line of the plurality of data lines and a first node;

a first capacitor electrically and physically connected between the first node and a second node;

a second capacitor electrically and physically connected between a third node and a fourth node;

a second transistor electrically and physically connected between the second node and the third node;

a third transistor comprising a gate electrode connected to the fourth node, a source electrode to which a first power source voltage is transmitted, and a drain electrode connected to a fifth node;

a fourth transistor which transmits an initialization voltage to the fifth node; and a fifth transistor electrically and physically connected between the third transistor and an organic light emitting diode.

2. The organic light emitting diode display of claim 1, wherein the frame period further comprises:

an initialization period during which the plurality of pixels are initialized, and a data transmission period during which the first data signal written to the first capacitor is transmitted to the second capacitor.

3. The organic light emitting diode display of claim 2, wherein the fourth transistor is maintained in a turn-on state during the initialization period.

4. The organic light emitting diode display of claim 2, wherein a threshold voltage of the third transistor is compensated during the data transmission period.

5. The organic light emitting diode display of claim 4, wherein each of the plurality of pixels further comprises a sixth transistor which diode-connects the gate electrode and the drain electrode of the third transistor during the data transmission period.

6. The organic light emitting diode display of claim 2, wherein each of the plurality of pixels further comprises:

a seventh transistor which transmits a reference voltage to the second node; and an eighth transistor which transmits the reference voltage to the third node.

7. The organic light emitting diode display of claim 6, wherein the seventh transistor and the eighth transistor are maintained in a turn-on state during the scan period and the initialization period.

8. The organic light emitting diode display of claim 2, wherein the second transistor are maintained in a turn-off state during the scan period, and maintained in a turn-on state during the initialization period and the data transmission period.

9. The organic light emitting diode display of claim 1, wherein the first data signal is an image data signal of one of a first view point and a second view point corresponding to the frame, and the second data signal is an image data signal of the other of the first view point and the second view point corresponding to the previous frame.

10. The organic light emitting diode display of claim 9, wherein the frame period further comprises a blank period which overlaps the scan period by a predetermined time, and the organic light emitting diode does not emit light during the blank period.

11. The organic light emitting diode display of claim 10, wherein the fifth transistor is maintained in a turn-off state during the blank period.

12. A method of driving an organic light emitting diode display comprising a plurality of pixels, the method comprising:

transmitting a first data signal, which is a data signal of a frame, to the plurality of pixels through a plurality of data lines connected to the plurality of pixels during a frame period of the frame, and storing the first data signal in a first capacitor of each of the plurality of pixels during a scan period in the frame period; and simultaneously emitting light from a plurality of organic light emitting diodes of the plurality of pixels based on a driving current corresponding to a second data signal, which is a data signal of a previous frame, during a light emission period in the frame period, wherein the scan period and the light emission period overlap each other in the frame period, and each of the plurality of pixels comprises:

a first transistor electrically and physically connected to a corresponding data line of the plurality of data lines and a first node;

the first capacitor electrically and physically connected between the first node and a second node;

a second capacitor electrically and physically connected between a third node and a fourth node;

a second transistor electrically and physically connected between the second node and the third node;

a third transistor comprising a gate electrode connected to the fourth node, a source electrode to which a first power source voltage is transmitted, and a drain electrode connected to a fifth node;

a fourth transistor which transmits an initialization voltage to the fifth node; and a fifth transistor electrically and physically connected between the third transistor and an organic light emitting diode.

13. The method of claim 12, further comprising:

initializing the drain electrode of the third transistor to the initialization voltage during an initialization period in the frame period; and transmitting the first data signal written to the first capacitor to the second capacitor during a data transmission period in the frame period.

14. The method of claim 13, wherein the transmitting the first data signal comprises compensating a threshold voltage of the third transistor.

15. The method of claim 14, wherein the compensating the threshold voltage comprises diode-connecting the gate electrode and the drain electrode of the third transistor.

16. The method of claim 13, further comprising:

transmitting a reference voltage to the second node and the third node during the scan period and the initialization period.

17. The method of claim 12, further comprising:

stopping a light emission from the plurality of organic light emitting diodes during a blank period in the frame period, wherein the blank period overlaps the scan period by a predetermined time.

* * * * *